US005951337A

United States Patent [19]

Brake

[11] Patent Number: 5,951,337

[45] Date of Patent: Sep. 14, 1999

[54] DAMAGE-RESISTANT ELECTRICAL CONNECTOR PLUG AND COMBINATION

[75] Inventor: Jeffry Robert Brake, Orange, Calif.

[73] Assignee: Desco Industries, Inc., Walnut, Calif.

[21] Appl. No.: 08/867,004

[22] Filed: Jun. 2, 1997

[51] Int. Cl.[6] ..... H01R 13/05

[52] U.S. Cl. ..... 439/825

[58] Field of Search ..... 439/825, 884

[56] References Cited

U.S. PATENT DOCUMENTS

| | | | |
|---|---|---|---|
| 2,564,098 | 8/1951 | Dorjee | 173/363 |
| 4,752,253 | 6/1988 | Neumann et al. | 439/825 |
| 4,944,701 | 7/1990 | Spinner | 439/827 |

FOREIGN PATENT DOCUMENTS

| | | | |
|---|---|---|---|
| 340878 | 10/1959 | Sweden | 439/825 |

OTHER PUBLICATIONS

Copy of drawing M–3819 by Assignee, Desco Industries, but with dimensions removed.

*Primary Examiner*—Gary F. Paumen
*Assistant Examiner*—Briggitte R. Hammond
*Attorney, Agent, or Firm*—Oppenheimer Wolff & Donnelly LLP

[57] ABSTRACT

An electrical connector element of the banana plug type which includes an elongate metal body having a core and a base. The base is connected to a lead or wire, and the core has a nose thereon at the end thereof remote from the base. The base and the nose form shoulders at the regions thereof adjacent the core. The surface of the core between the shoulders is a surface of revolution about the axis of the core. The surface of revolution is relatively close to the axis at regions near the shoulders and relatively far from the axis at regions far from the shoulders. The connector element further includes an electrically conductive spring, such as a barrel spring, mounted coaxially on the core between the shoulders. The spring has a central region located outwardly of the regions of the surface of revolution that are far from the axis.

13 Claims, 2 Drawing Sheets

DAMAGE-RESISTANT ELECTRICAL CONNECTOR PLUG AND COMBINATION

BACKGROUND OF THE INVENTION

There have for many years been used large numbers of electrical plug-and-socket combinations including banana plugs. And, presumably for the same many years, the plugs have been abused. They have been accidentally stepped on, pinched, etc., in such manners as to make their springs become at least somewhat flattened. This has caused the effectiveness and usability of the abused plugs to be reduced or eliminated.

Attempts to make banana plugs resistant to such abuse have up until now been unsuccessful, or only partly successful. There has long been a need for a successful—but inexpensive—solution to the abuse problem. The need has been a significant one, especially because when a banana plug goes out of service, so also do the associated wire (lead) and circuitry.

SUMMARY OF THE INVENTION

In accordance with one aspect of the invention, the body of a banana plug is provided with at least one stop surface that limits inward movement of the spring to such an extent that the spring does not usually exceed its elastic limit when the banana plug is stepped on or similarly abused. The stop surface is so located and shaped as not to interfere with normal operation of the spring in making good resilient electrical contact with the associated socket.

In accordance with another aspect of the invention, the core of the banana plug body is shaped generally correspondingly to the associated spring or springs, with sufficient space between them that the spring can perform its normal function in an effective manner, but sufficiently close to prevent damage to the spring when the banana plug is abused.

In accordance with a further aspect of the invention, there is provided a banana plug and socket combination in which the diameter of the socket is such as to compress the spring or springs inwardly sufficiently to achieve good electrical contact, but not sufficiently to cause the spring or springs to engage a stop surface unless the banana plug is abused. Such stop surface is located to prevent the spring from exceeding its elastic limit when abused.

DETAILED DESCRIPTION OF THE PREFERRED EMBODIMENT

Banana plugs have different kinds of metal springs, such as the barrel type and the blade type—as is well known in the art. There is shown in this application the barrel type, but the present combination may—alternatively—include blade springs and the like.

In this specification and claims, the words "inwardly" and "outwardly" mean in a radial—not longitudinal—direction.

Figure 1:
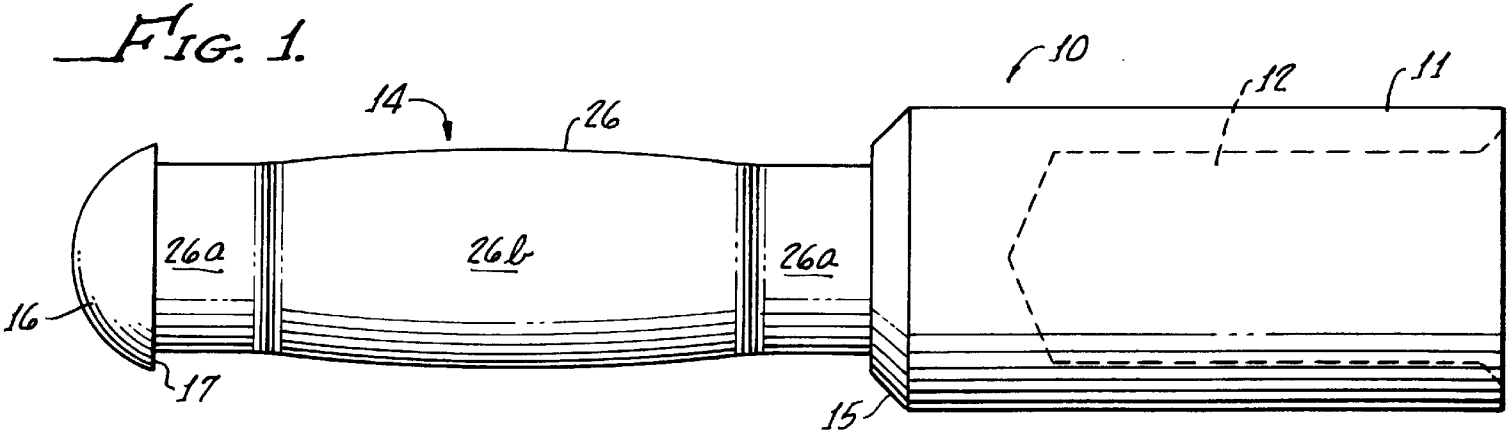
FIG. 1 is a side elevational view showing the body of the banana plug, including the core portion of such body.
Figure 2:
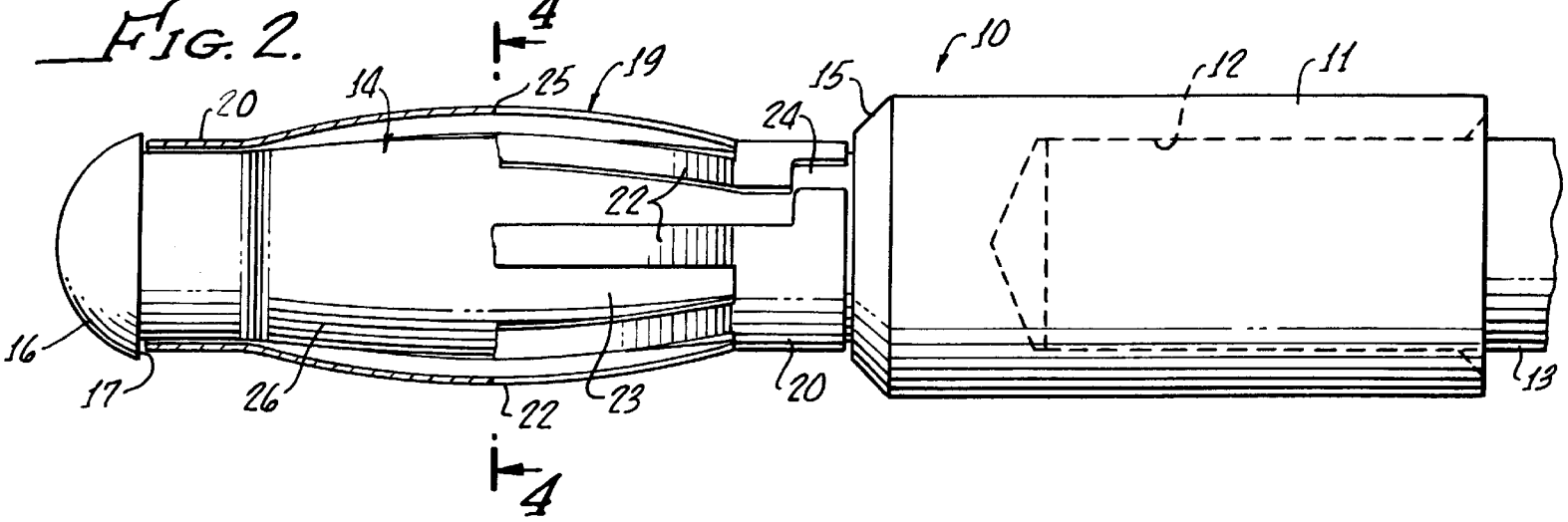
FIG. 2 is a side elevation showing a barrel spring associated with the core portion in coaxial relationship; the left portion of the spring being broken away and sectioned.

Referring first to FIG. 1, the metal body 10 of the present banana plug is elongate and is typically small in diameter. It has an elongate cylindrical base 11 that is hollow (as shown at 12) in order to receive in electrically-and-mechanically connected relationship the end of a lead or wire 13 (FIG. 2).

Extending axially from the end of base 11 that is remote from lead 13 is an elongated core 14. In the illustrated preferred form, core 14 is smaller in diameter than base 11; a beveled shoulder 15 is formed radially-outwardly of the junction between core 14 and base 11.

At the end of core 14 remote from base 11 is formed a generally hemispherical nose or cap 16, the rounded surface of which is on the side remote from base 11. The diameter of nose 16 is substantially larger than that of the adjacent region of core 14, so that a radial shoulder 17 is formed where nose and core meet.

In the illustrated embodiment, a barrel spring 19 is provided around core 14 between shoulders 15 and 17. As is well known in the art, such spring is made of a single piece of flat spring metal. It has corresponding cylindrical ends 20 that fit around core 14 adjacent the respective shoulders 15,17. Between ends 20 are elongate curved spring elements 22 that resemble barrel staves, these being separated from adjacent spring elements by slots. There are longitudinal regions 24 where the longitudinal side edges of spring 19 are adjacent each other, or abut each other.

The central portion of barrel spring 19 may be termed a bulge region; it is continuously curved outwardly and then inwardly, for example as shown in FIG. 2. In the illustrated preferred form, the barrel spring 19 and the bulge region thereof are symmetrical about a "medial plane" (not shown) that is perpendicular to the axis of core 14, and that is also midway between shoulders 15 and 17.

In the illustrated preferred form, the portion of spring 19—and of its bulge—farthest from the axis of core 14 is located at the above-specified medial plane. This central portion of spring 19 lies in a circle lying in the stated plane and centered at the axis of core 14. A point on such circle is indicated at 25 in FIG. 2.

Preferably, the entire body 10 is an integral element formed (as on a screw machine) from a single piece of (preferably) hard brass.

In accordance with the present invention, there is a stop provided inwardly of the bulge region and that prevents the bulge region from being stressed past its elastic limit when stepped on, etc.

In the illustrated preferred form, the stated stop is at least one surface of revolution about the axis of core 14, which surface has at least some portions the diameters of which are significantly larger than those of core 14 at its regions adjacent shoulders 15 and 17. The surface of revolution is adapted to be engaged by spring elements 22 when they are pushed inwardly in response to abuse. On the other hand, the surface of revolution is so located that it is not engaged by spring elements 22 until they are pushed inwardly by abuse. The free (unstressed) positions of the spring elements are such that there is space between them and the surface of revolution except during abuse.

Preferably, there is the illustrated surface of revolution 26 about the axis of the core, and that extends from shoulder 15 to shoulder 17. Such surface of revolution 26 is formed on core 14 during manufacture of body 10, and at very little expense. Surface 26, as shown in FIG. 2, bulges progressively and continuously outwardly from end portions 26*a* relatively near the shoulders, to a mid portion that is located radially-inwardly from the above specified circle containing point 25. The end portions 26*a* of the surface 26 are cylinders.

The surface of revolution 26 is, at least at region 26*b* thereof that is spaced from the shoulders 15,17, generally parallel to and spaced inwardly from the spring elements 22. The amount of such inward spacing is determined in relation to the diameter of the socket associated with the banana plug. Thus, the amount of such inward spacing is made sufficiently large that when the banana plug is inserted in its associated socket, the spring elements 22 engage the wall of the socket and are (at and near the engaged regions) pressed inwardly, but are not pressed inwardly sufficiently far to engage surface 26. In addition, the amount of such inward spacing is caused to be sufficiently small that when the spring elements 22 are pressed (as by being stepped on) into engagement with surface 26 they will not have been bent far enough that their elastic limit is exceeded.

There results are, therefore:

1. When the spring elements 22 are in contact with the interior wall of the associated socket they are in good, resilient electrical contact therewith, and there is sufficient friction to prevent undesired withdrawing of the banana plug from its socket.
2. After the banana plug is intentionally withdrawn from its socket, and then accidentally stepped on, etc., at least some of the spring elements 22 are pushed inwardly into contact with stop surface 26. They are prevented by such surface from being bent inwardly until their elastic limit is exceeded. Accordingly, when the abuse is discontinued the elements 22 spring outwardly to their original free positions. They are therefore not destroyed, but spared to make subsequent electrical connections.

Figure 3:
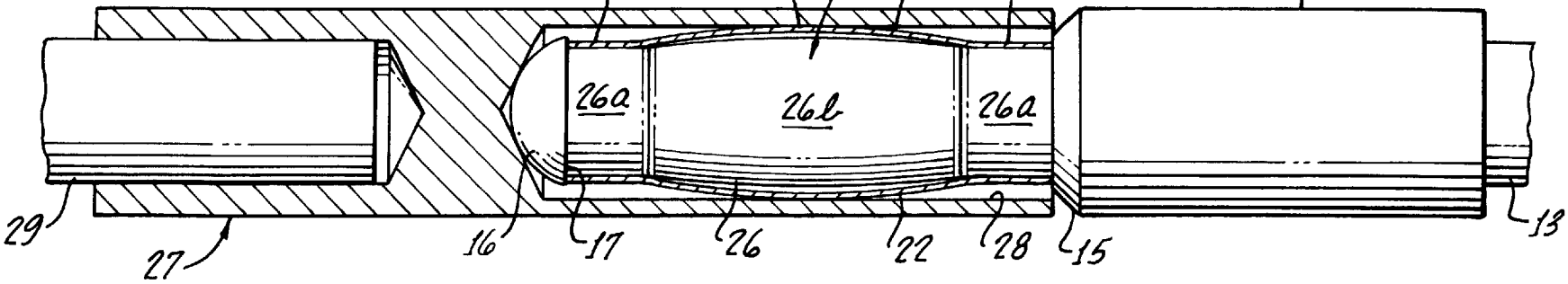
FIG. 3 is a view, mostly in longitudinal section, showing of the banana plug and the associated socket.
Figure 4:
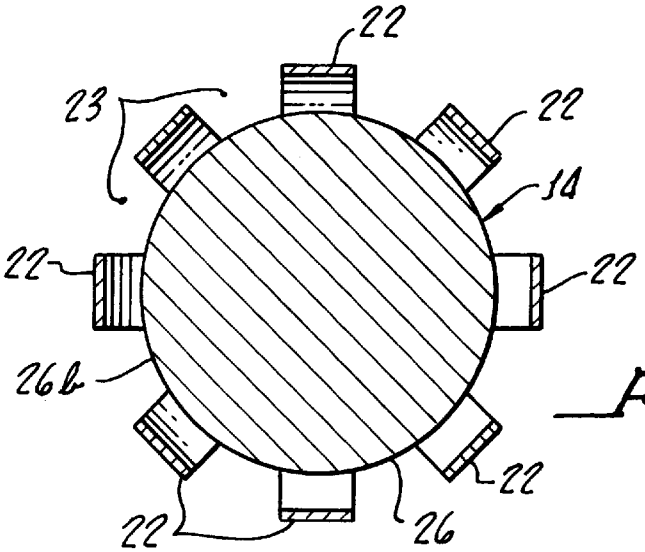
FIG. 4 is a cross-section taken on line 4—4 of FIG. 2.

A socket (banana jack) for the banana plug is shown at 27 in FIG. 3. It has an interior cylindrical surface 28 adapted to be resiliently engaged by the central regions of elements 22. The diameter of surface 28, in relation to spring 19, meets the criteria stated above. Socket 27 is electrically and mechanically connected to a lead or wire 29.

SPECIFIC EXAMPLE

Length of body 10—0.96 inch

Distance between shoulders 15 and 17—0.485 inch

Length of base 11—0.400 inch

Diameter of nose 16—0.15 inch

Diameter of surface of revolution 26 at all portions thereof that are within 0.080 inch from shoulder 15 or shoulder 17—0.129 inch Diameter of surface of revolution 26 at its largest point (in a plane perpendicular to the axis of core 14, and midway between the shoulders)—0.145 inch Diameter of socket surface 28—0.160 inch Diameter of barrel spring 19 at its largest point—0.190 inch (when the spring is in free condition)

Length of barrel spring 19 (when in free condition)—0.478 inch

The barrel spring 19 is made of beryllium copper, quarter hard, nickel plated spring. The spring sheet metal of which the spring is made is 0.008 inch thick.

The barrel springs may be purchased from Desco, of Walnut, Calif., as part No. P-3821.

The foregoing detailed description is to be clearly understood as given by way of illustration and example only, the spirit and scope of this invention being limited solely by the appended claims.

What is claimed is:

1. An electrical connector element of the banana plug type, which comprises:

(a) an elongated metal body having a core and a base,
 said base being connected to a lead or wire,
 said core having a nose thereon at an end thereof remote from said base,
 said base and said nose forming shoulders at regions thereof adjacent said core, a surface of said core between said shoulders being a surface of revolution about an axis of said core, said surface of revolution being relatively close to said axis at regions near said shoulders and relatively far from said axis at regions far from said shoulders; and (b) electrically conductive spring means mounted coaxially on said core between said shoulders,
 said spring means having a central region located outwardly of said regions of said surface of revolution that are far from said axis;

wherein said core bulges progressively and continuously outward from end portions to a mid portion thereof.

2. The invention as claimed in claim 1, in which said spring means is a barrel spring.

3. The invention of claim 1 wherein opposite end portions of said core are cylindrical.

4. The invention of claim 1 wherein end portions of said spring means are cylindrical.

5. The invention as claimed in claim 1, in which said spring means when in a free condition is spaced outwardly from said surface of revolution, but is sufficiently close to said surface of revolution that stepping on said spring means until said spring means is pushed inwardly into engagement with said surface of revolution does not stress said spring means beyond its elastic limit.

6. The invention as claimed in claim 5, in which an electrically conductive socket is provided and has a cylindrical interior surface, said socket being connected to a lead or wire, the diameter of said interior surface being such that said core and spring means may be inserted into said socket, and when so inserted said central region of said spring means will be compressed by said interior surface but not sufficiently compressed to engage said surface of revolution.

7. The invention as claimed in claim 6, in which said spring means is a barrel spring.

8. The invention as claimed in claim 6, in which, when said spring means is in a free condition, regions of said spring means and said surface of revolution that are relatively remote from said shoulders are generally parallel to each other and are spaced from each other.

9. A banana-plug-type electrical connector element, comprising:

an elongated body having a base at one end thereof, and an electrically-conductive elongate core at an opposite end thereof and extending out from said base, said base being connected to a lead or wire; and an electrically conductive spring coaxially disposed about said core;

said core including stop means for defining a stop surface shaped and sized with said core operatively in a socket and said spring operatively compressed in the socket so as to be spaced inwardly from said spring and out of contact therewith, and shaped and sized with said spring being stepped on or otherwise abused so as to prevent said spring, from exceeding its elastic limit, said core including cylindrical ends, and said stop surface having a maximum diameter larger than the maximum diameters of said cylindrical ends;

wherein said core includes cylindrical end portions; and wherein said core bulges progressively and continuously outward from said cylindrical end portions to a mid portion of said core.

10. The element of claim 9 wherein said maximum diameter is at a mid portion of said stop surface.

11. The element of claim 9 wherein a plane perpendicular to a longitudinal axis of said core intersecting said stop surface at any location along the length of said stop surface defines a circle.

12. The element of claim 9 wherein said stop surface, said base and said cylindrical ends are integrally formed as a single unit.

13. An electrical connector element of the banana plug type, which comprises:

(a) an elongated metal body having a core and a base, said base being connected to a lead or wire, said core having a nose thereon at an end thereof remote from said base, said base and said nose forming shoulders at regions thereof adjacent said core, a surface of said core between said shoulders being a surface of revolution about an axis of said core, said surface of revolution being relatively close to said axis at regions near said shoulders and relatively far from said axis at regions far from said shoulders; and (b) electrically conductive spring means mounted coaxially on said core between said shoulders, said spring means having a central region located outwardly of said regions of said surface of revolution that are far from said axis;

wherein end portions of said spring means are cylindrical.

* * * * *